US008561687B2

(12) United States Patent
Moore et al.

(10) Patent No.: US 8,561,687 B2
(45) Date of Patent: Oct. 22, 2013

(54) PRESSURE CONTAINMENT DEVICES AND METHODS OF USING SAME

(75) Inventors: Daryl Moore, Calgary (CA); Tom Brocklebank, Calgary (CA); Scott Sherman, Calgary (CA)

(73) Assignee: Trican Well Service Ltd., Calgary, Alberta (CA)

( * ) Notice: Subject to any disclaimer, the term of this patent is extended or adjusted under 35 U.S.C. 154(b) by 812 days.

(21) Appl. No.: 12/160,058

(22) PCT Filed: Jan. 8, 2007

(86) PCT No.: PCT/CA2007/000015

§ 371 (c)(1),
(2), (4) Date: Nov. 10, 2008

(87) PCT Pub. No.: WO2007/076609

PCT Pub. Date: Jul. 12, 2007

(65) Prior Publication Data

US 2009/0078405 A1 Mar. 26, 2009

(30) Foreign Application Priority Data

Jan. 6, 2006 (CA) ..... 2532295
Jul. 14, 2006 (CA) ..... 2552072

(51) Int. Cl.
*E21B 23/00* (2006.01)

(52) U.S. Cl.
USPC ..... 166/127; 166/191; 166/121

(58) Field of Classification Search
USPC ..... 166/121, 133, 184, 202, 250.1, 259, 166/271, 281, 283, 308.1, 177.5, 191, 127
See application file for complete search history.

(56) References Cited

U.S. PATENT DOCUMENTS

| | | | | |
|---|---|---|---|---|
| 3,346,045 | A | 10/1967 | Knapp et al. | |
| 3,394,760 | A | 7/1968 | Childers et al. | |
| 3,525,401 | A | 8/1970 | Hanson et al. | |
| 3,897,826 | A | 8/1975 | Hutchison | |
| 5,845,711 | A | 12/1998 | Connell et al. | |
| 6,260,623 | B1 | 7/2001 | Schick | |
| 6,439,302 | B1 | 8/2002 | Wiedemann | |
| 6,446,727 | B1 * | 9/2002 | Zemlak et al. | 166/308.1 |
| 2006/0000620 | A1 * | 1/2006 | Hamilton | 166/387 |

FOREIGN PATENT DOCUMENTS

| | | | |
|---|---|---|---|
| RU | 44739 | U1 | 3/2005 |
| SU | 1315603 | A1 | 6/1987 |

OTHER PUBLICATIONS

RU Official Action, Mar. 17, 2010.

A.P. Silash, "*Oil and Gas Production and Transportation*", Part 1, All-Union Patent Technical Library, Moscow, Nedra Publishing, pp. 1-2 (1980), (in English and Russian languages).

A.F. Nazarova, Sr. Editor, Series "*Oil Field Business*", Ministry of Oil Industry, The All-Union Scientific and Research Institute of Organization, Management and Economics of Oil Industry, Moscow 1984, 5(77);3-5 (in English and Russian languages).

* cited by examiner

*Primary Examiner* — Yong-Suk (Philip) Ro
(74) *Attorney, Agent, or Firm* — David R. Heckadon; Gordon Rees LLP

(57) ABSTRACT

Moveable and split packer cups for use above a conventional coiled tubing fracturing or stimulation tool are described as well as methods for running these tools into a wellbore. These devices can be used for extended stimulation intervals with coiled tubing, as well as for a secondary pressure containment to avoid pressure communication with uphole formations or perforations.

10 Claims, 13 Drawing Sheets

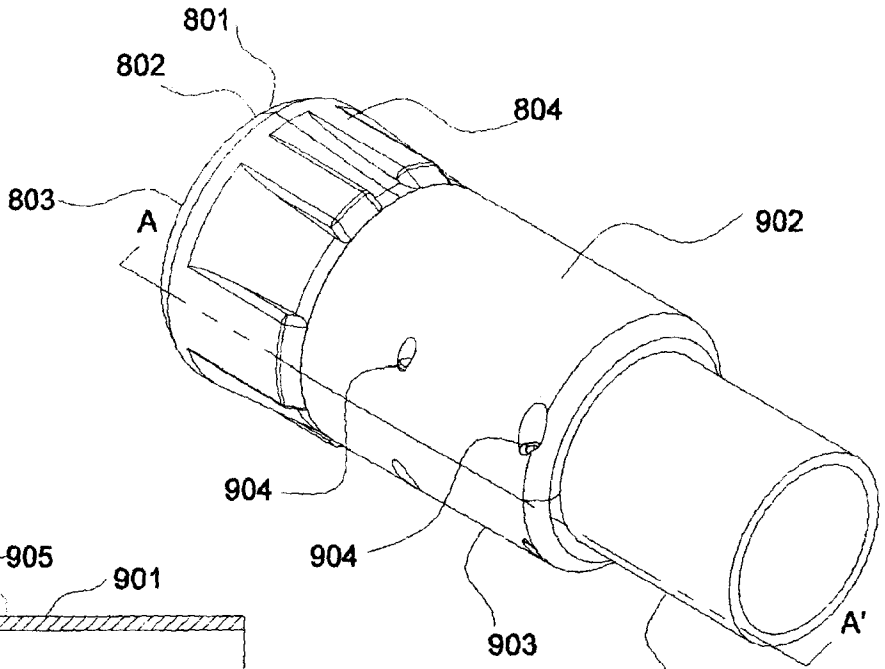
Figure 9A
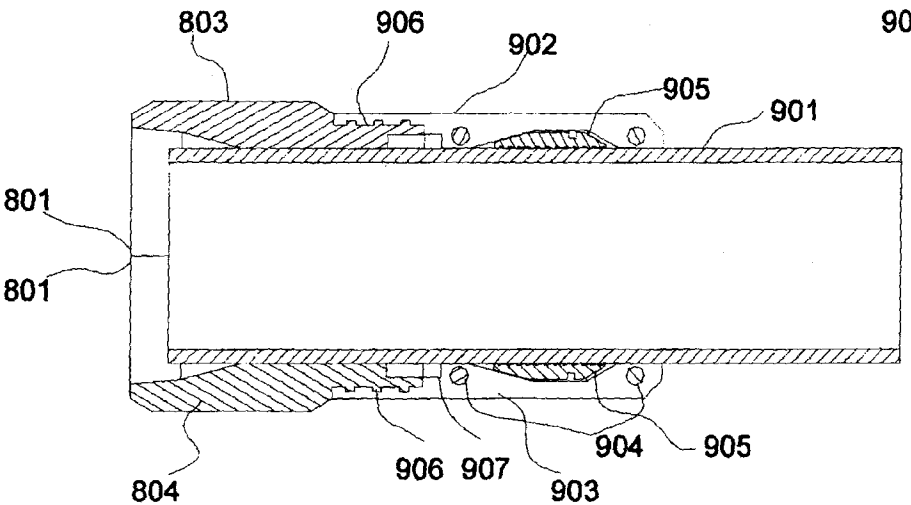
Figure 9B (Section A-A')

PRESSURE CONTAINMENT DEVICES AND METHODS OF USING SAME

CROSS REFERENCE TO RELATED APPLICATIONS

This application claims priority from International Patent Application Number PCT/CA2007/000015 filed on Jan. 8, 2007 which claims priority from Canadian patent Application Serial No. 2,532,295 filed Jan. 6, 2006 and Application Serial No. 2,552,072 filed Jul. 14, 2006.

FIELD OF THE INVENTION

This invention relates to hydraulically fracturing or stimulating subterranean formations with coiled tubing for improved production of oil and gas, and in particular, to pressure containment devices.

BACKGROUND OF THE INVENTION

Hydraulically fracturing or stimulation of subterranean formations to increase oil and gas production has become a routine operation in the petroleum industry. In hydraulic fracturing, a fracturing fluid is injected through a wellbore into the formation at a pressure and flow rate sufficient to overcome the overburden stress and to initiate a fracture in the formation. The fracturing fluid may be a water-based liquid, oil-based liquid, liquefied gas such as but not limited to carbon dioxide, dry gases such as but not limited to nitrogen, or combination of liquefied and dry gases, or some combination of any of these or other fluids. It is most common to introduce a proppant into the fracturing fluid, whose function is to prevent the created fractures from closing back down upon itself when the pressure is released. The proppant is suspended in the fracturing fluid and transported into a fracture. Proppants in use include 20-40 mesh size sand, ceramics, and other materials that provide a high-permeability channel within the fracture to allow for greater flow of oil or gas from the formation to the wellbore.

Stimulation techniques may include the introduction of an acid to dissolve formation or drilling damage, or the introduction of solvent fluids to remove paraffins or wax build-up, or other such techniques.

Production of petroleum or natural gas can be enhanced significantly by the use of these techniques.

Hydraulic fracturing with coiled tubing is a common operation. It generally uses a bottomhole assembly comprised of opposing sets of one or more pressure containment devices such as fracture or packer cups fixed to a length of piping typically heavier in wall thickness than the coiled tubing string. The distance between the two sets of opposing fracture cups determine the length of formation interval to be fractured by virtue of the fact that the cups are fixed to the bottomhole assembly. It is not uncommon in this type of operation to be limited in the length of the interval to be fractured by the distance between the frac cups, which in itself can be limited by lubricator length and / or crane height. Thus there is a maximum distance apart that the perforations can be placed in the casing for the tool to straddle them and isolate the perforations of interest from other sets of perforations higher or lower in the wellbore.

In typical operations, it is desirable to leave the well in a live condition, meaning it is left to flow while operations are being conducted and is not killed with water or heavier liquids. In the case of live-well operations, coiled tubing is seen as having a significant advantage over jointed pipe operations as pressure control at surface is continuous while moving the coiled tubing in and out of the well and there are no joints to be made in the string after the tools are in the wellbore.

To effect a live-well operation, tools used for fracturing are lubricated in and out of the wellbore, a process in which the tools are attached to the coiled tubing and housed in a length of pressure-integral piping known as lubricator and attached to the wellbore above the coiled tubing blowout preventers (BOPs), which themselves are attached to a pressure control valve, commonly referred to as a master valve. After connecting the lubricator housing the coiled tubing fracturing tool and coiled tubing to the master valve, the lubricator system is tested to ensure it holds wellbore pressure without leaking. Well pressure is then contained by the coiled tubing stripper or stuffing box, situated between the lubricator and the injector. Once pressure integrity of the system has been established through testing, the master valve can be opened and the fracturing tool and coiled tubing run into the wellbore to the desired depth for fracturing operations, with the entire operation conducted under live conditions.

In conducting these operations, it is not uncommon for the fracture initiated in one zone or zones to breakthrough behind the casing to an upper zone or zones through open perforations in the casing, thereby reducing the effectiveness of the current fracture treatment, and also potentially impairing future fracture treatments on the upper zone or zones. For example, in stimulating a well in rock that has natural fractures in it, if there are multiple zones of interest to be stimulated, applying pressure to one set of perforations (e.g, the lowest in the wellbore) will cause the fracturing fluid to "short circuit" and follow the natural fractures in the rock and come up to the upper set of perforations, rather than going out into the formation. If a fracturing operations were conducted under these conditions, the proppants, such as sand, carried by the fluid follows the natural fractures and will enter at the bottom set of perforations, loop to the upper perforations and then fall down the wellbore along the tool and pile up behind the lowest packer cup. The tool is then stuck in the hole as it cannot be pulled up against the sandpile. The coiled tubing would need to be cut off to get the tool out. This is very expensive and undesirable, as there are tools stuck at the bottom, the well is no longer being stimulated, and the tools need to be retrieved.

SUMMARY OF THE INVENTION

The present invention is able to avoid the problem of "short circuiting" as discussed above. It is able to avoid this short circuit by utilizing a movable top cup, i.e. the distance between the moveable top cup and the fixed bottom cup is variable and can be selected by the crew at the well site. For example, the moveable top cup is placed higher than the top perforations so that both sets of perforations are stimulated simultaneously. The well column is full of fluid (usually water) and because the top cup seals, the water cannot travel upward toward the surface. Thus there is no flow through the natural fractures, and no proppant (i.e. sand) gets piled on top of the lower cup, and the tool can be removed when the job is completed. Instead the fluid and sand is pushed through the perforations and out into the formation.

Accordingly, in one aspect, the invention relates to a method of pressure containment in a wellbore comprising the steps of providing coiled tubing; providing a movable pressure containment device on the tubing; inserting the tubing into the wellbore to a first depth while maintaining the movable pressure containment device at the surface and passing tubing through the movable pressure containment device;

fixing the movable pressure containment device in a position on the tubing; and, inserting the tubing into the wellbore to a second depth. The method can further include a bottomhole assembly and wherein the first pressure containment device is fixed to the bottomhole assembly with at least one non-movable pressure containment device fixed on the bottomhole assembly. The bottomhole assembly can be a fracturing tool. The movable pressure containment device can include a lock for fixing the movable pressure containment device on the tubing such that the tubing is not permitted to pass through the pressure containment device while the tubing is inserted into the wellbore to the second depth. The method can be used for primary, secondary and tertiary pressure containment.

In another aspect, the invention relates to a method of pressure containment in a wellbore comprising the steps of providing coiled tubing, running the coiled tubing into a wellbore to a first depth; attaching a pressure containment device on the tubing at the surface; and running the coiled tubing into the wellbore to a second depth and can include a bottomhole assembly connected to the tubing. The bottomhole assembly can include at least one non-moveable pressure containment device. The device can be a split cup.

In a further aspect, the invention relates to a method of pressure containment in a wellbore comprising the steps of: providing coiled tubing with a first fixed pressure containment cup on the tubing; providing a movable pressure containment cup on the tubing; running the tubing into the wellbore to a first depth while maintaining the movable pressure containment cup at the surface and passing tubing through the movable pressure cup; fixing the movable cup in a position on the tubing; and running the tubing into the wellbore to a second depth.

In a still further aspect, the invention relates to a method of pressure containment in a wellbore comprising the steps of: providing coiled tubing with a first fixed pressure containment cup on the tubing; running the tubing into the wellbore to a first depth; providing and fixing a pressure containment means in a position on the tubing that is not the end of the tubing; and running the tubing into the wellbore to a second depth.

In another aspect, the invention relates to a fluid containment device for sealing fluid within a wellbore comprising a sleeve for placement on coiled tubing and releasable locking means for locking the device onto the coiled tubing whereby when the locking means is in an unlocked position, coiled tubing can be passed through the device. The device can be a packer cup or fracturing cup.

In another aspect, the invention relates to a coiled tubing assembly comprising coiled tubing and a movable pressure containment means on the tubing. The assembly can include a first fixed pressure containment cup on the tubing downhole of the movable containment means.

In another aspect, the invention relates to a fluid containment cup for containing fluid within a wellbore comprising two sleeve halves.

BRIEF DESCRIPTION OF THE DRAWINGS

The invention is described below in greater detail with reference to the accompanying drawings which illustrate embodiments of the invention and wherein:

FIG. 9A is a perspective view of a split cup assembly according to the inventions;

FIG. 9B is a cross-section of the assembly of FIG. 9A; and

DETAILED DESCRIPTION

Figure 1:
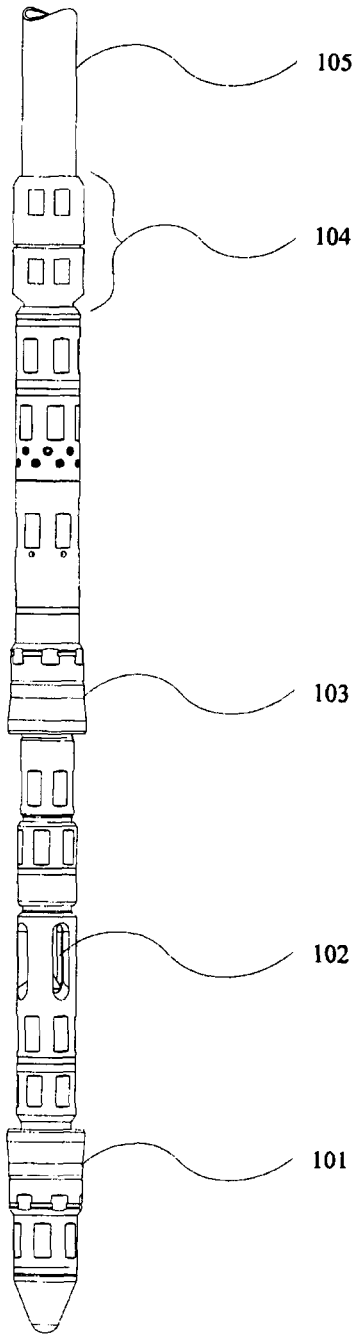
FIGURE 1 (Prior Art)
FIG. 1 is a side view of a prior art (conventional) coiled tubing fracturing tool.

In one embodiment of the present invention there is provided a method of fracturing or stimulating a subterranean formation using coiled tubing with a set of opposing pressure containment devices. These devices may be fracture cups or packer cups, inflatable packer elements, or other such devices that will contain an introduced pressure between the pressure containment devices. Prior art in coiled tubing fracturing utilizes a set of opposing fracture or packer cups fixed to a bottom hole assembly, which is attached to a string of coiled tubing. In the present invention, however, the upper pressure containment device or devices are designed such that they can be strategically placed at a location on the coiled tubing to allow significantly larger intervals to be fractured while still preserving live well operations. In other words, the upper pressure containment device or devices are "moveable" in that the distance between them and the lower non-moveable pressure containment devices is variable and can be adjusted by the crew at the well site.

The present invention in another embodiment is a set of opposing fracture cups for use in fracturing a subterranean formation using coiled tubing. An additional upper cup or set of cups are included that can be strategically placed at a location on the coiled tubing to allow a pressure barrier inside the casing to prevent pressure communication with uphole zone or zones from within the casing.

A split cup design, in one embodiment according to the invention, can be used in a fracturing or stimulation process for either extended fracture or stimulation intervals or as secondary pressure containment in the event of breakthrough behind the casing.

A coiled tubing fracturing tool is connected to the coiled tubing and lubricated into the wellbore as per traditional methods. If the intent of the operation is for extended fracture or stimulation intervals, the coiled tubing fracturing tool would be similar to a conventional coiled tubing fracturing tool but without the upper cup or cups in place which allows injected fluids to communicate with the wellbore above the top of the coiled tubing fracturing tool. If the intent is for secondary pressure containment, the conventional coiled tubing fracturing tool will retain the upper cup as per traditional methods.

A coiled tubing work window is added to the wellhead assembly between the coiled tubing BOPs and lubricator. The work window is a pressure integral device that can be opened and closed to allow access to the coiled tubing while the master valve is opened and the coiled tubing is in the wellbore. Protection from well pressure when the window is open is provided by closing the annular bag and/or pipe rams of the coiled tubing BOPs, depending on the BOP configuration required.

The desired configuration of conventional coiled tubing frac tool, with or without upper cup or cups, are run into the wellbore under live conditions to a depth determined by the desired length of interval to be fractured or as determined by the next set of adjacent perforations. Once at this depth, the coiled tubing BOPs (annular bag and/or pipe rams) are activated to contain wellbore pressure, the lubricator system depressured, and the work window opened to gain access to the coiled tubing.

In one embodiment of the invention, when the coiled tubing is exposed to atmosphere, one or more sets of split cups are attached to the coiled tubing, and held in place by one or more sets of retaining or joining means. Once the split cup assembly (which includes cups and retaining means) is fixed to the coiled tubing, the work window is closed, the system pressure tested, and the BOPs opened to allow the coiled tubing to be run to the desired depth for fracturing operations.

At the completion of the fracturing operations, the coiled tubing is pulled out of the wellbore, the upper cup or cups are landed in the work window and removed following the reverse of the procedure used to install them on the coiled tubing.

In another embodiment according to the invention, a solid one-piece upper pressure containment device such as a fracture or packer cup is placed in the desired position on the coiled tubing string by way of a locating means situated in the BOP stack. The locating means may be a set of locator rams or a C-plate situated in the window or other such means to keep the upper cup or cups stationary while the coiled tubing is being moved into the wellbore. The procedure would still require a work window to allow access to fix the upper cup or cups to the coiled tubing string, such that the surface equipment would be the same as described above for the split cup embodiment.

The upper cup or set of cups with associated retaining means are placed over the coiled tubing string before the coiled tubing is attached to the frac tool carrying the bottom set of cup or cups. After the top cups are put onto the coiled tubing, the frac tool is connected. The top cups are manually situated on the coiled tubing above a set of locating rams which are situated just below the work window, or by a plate located in the work window, and are designed to hold the top cup or cups stationary while the coiled tubing is run into the well.

The bottom cup or set of cups is run into the wellbore under live conditions to a depth determined by the desired length of interval to be fractured or by the separation between the target perforations and the next adjacent perforations. Once at this depth, the coiled tubing BOPs (annular bag and/or pipe rams) are activated to contain wellbore pressure, the lubricator system depressured, and the work window opened to gain access to the coiled tubing and the top cup or cups which have been held at surface by the locating rams or the locating plate.

With the coiled tubing exposed to atmosphere, one or more sets of retaining devices are fixed to the coiled tubing such that the cup or cups are held securely in place on the coiled tubing. This retaining means may be a solid mandrel device which was located on the coiled tubing with the movable cup, a split clamp that is joined in the window, a helical holding device that can be wound onto the coiled tubing, or another such device that holds the cup or cups in place.

Once the upper cup assembly (which includes cups and retaining means) is fixed to the coiled tubing, the work window is closed, the system pressure tested, the BOPs opened, and the locating rams opened to allow the coiled tubing and upper cup assembly to be run to the desired depth for fracturing operations.

At the completion of the fracturing or stimulation operations, the coiled tubing is pulled out of the wellbore, the locating rams are closed such that the upper cup or cups are landed in the work window and removed following the reverse of the procedure used to install them on the coiled tubing.

It is understood that in certain embodiments, the basis of this invention is the process of using adjustable depth or movable pressure containment devices, which may be fracture cups or other similar devices, on coiled tubing to accommodate fracture or stimulation intervals of varying and extended lengths. There are several ways in which to introduce movable or adjustable depth cups into the wellbore on coiled tubing. Described above are several methods and devices, but the invention is not intended to be limited to these methods and devices and variations in both procedure and devices are anticipated.

The invention, in another embodiment, relates to a method and system comprising injecting pressurized gas, liquid, solid proppant material, acids or solvents, or a combination of these materials, at high rate and pressure to create, open, and propagate fractures within the formation or to dissolve materials within the formation. A coiled tubing fracturing tool or similar device is used to contain the injected pressure and material across the intended formation. The invention provides a means of strategically locating the upper cup or set of cups on the coiled tubing to enable fracture operations of extended lengths to be performed or in the case of secondary pressure containment a second upper cup or set of cups. The invention is not intended to be limited to the embodiments disclosed herein. In particular, modifications to the process and devices can be made which could include the use of specially coated or treated coiled tubing between the bottom fracturing cups and the upper fracturing cups to protect the coiled tubing from abrasion, and alternative methods of introducing the top cup or cups to the coiled tubing.

With reference to FIG. 1, a conventional coiled tubing fracturing tool consists, primarily, of a bottom cup or set of cups 101, an injection port 102, an upper cup or set of cups 103, and a coiled tubing connector 104 which connects the aforementioned assembly to coiled tubing 105.

Figure 2:
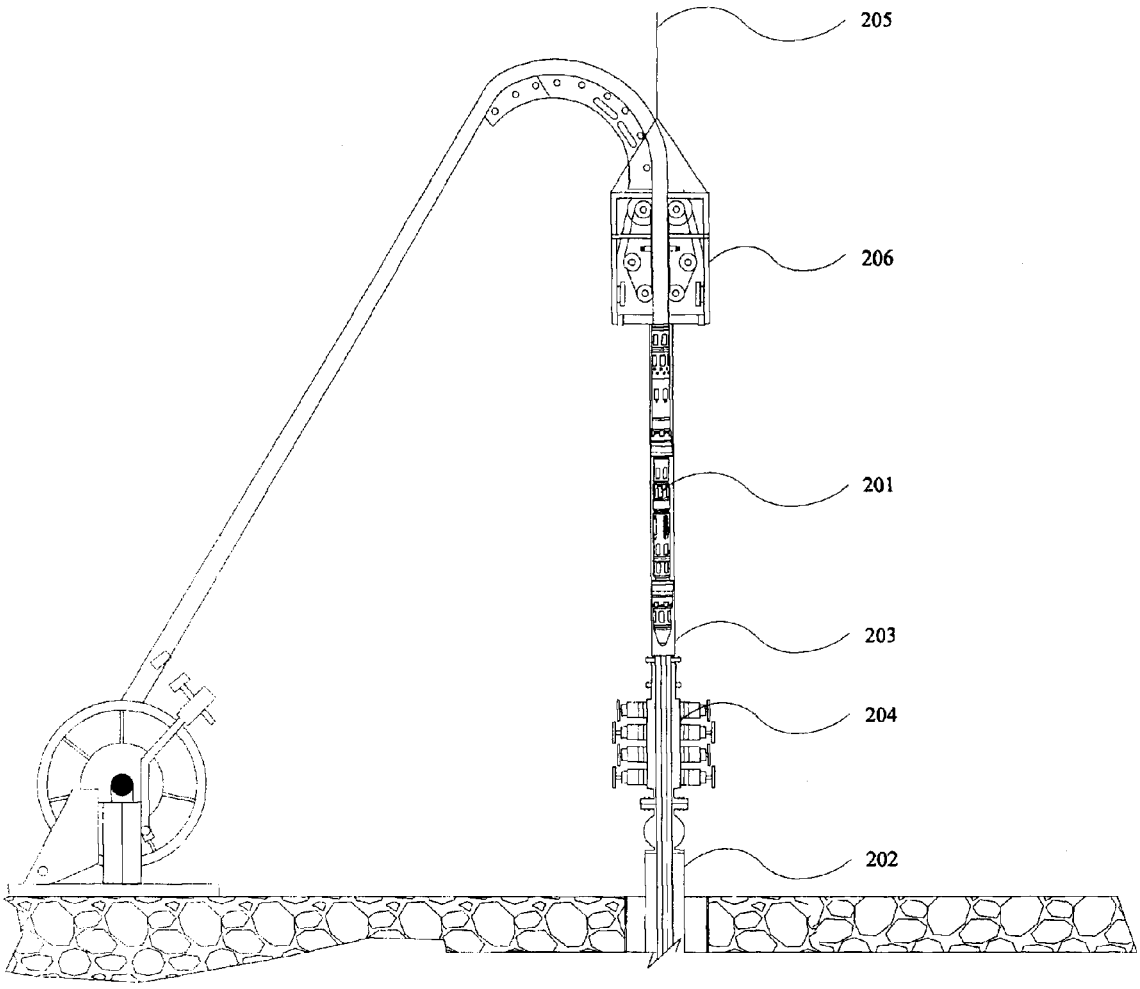
FIGURE 2 (Prior Art)
FIG. 2 is a side view of prior art equipment used in a conventional coiled tubing fracturing operation.

With reference to FIG. 2, the conventional coiled tubing fracturing tool 201 is lubricated into a wellbore 202 by housing the fracturing tool 201 in a lubricator 203 which is connected to a blowout prevention stack 204. It is clear that the length of the interval to be fractured or stimulated is limited by the available height of the crane 205 used to suspend the coiled tubing injector 206 above the wellbore 202.

Figure 3A:
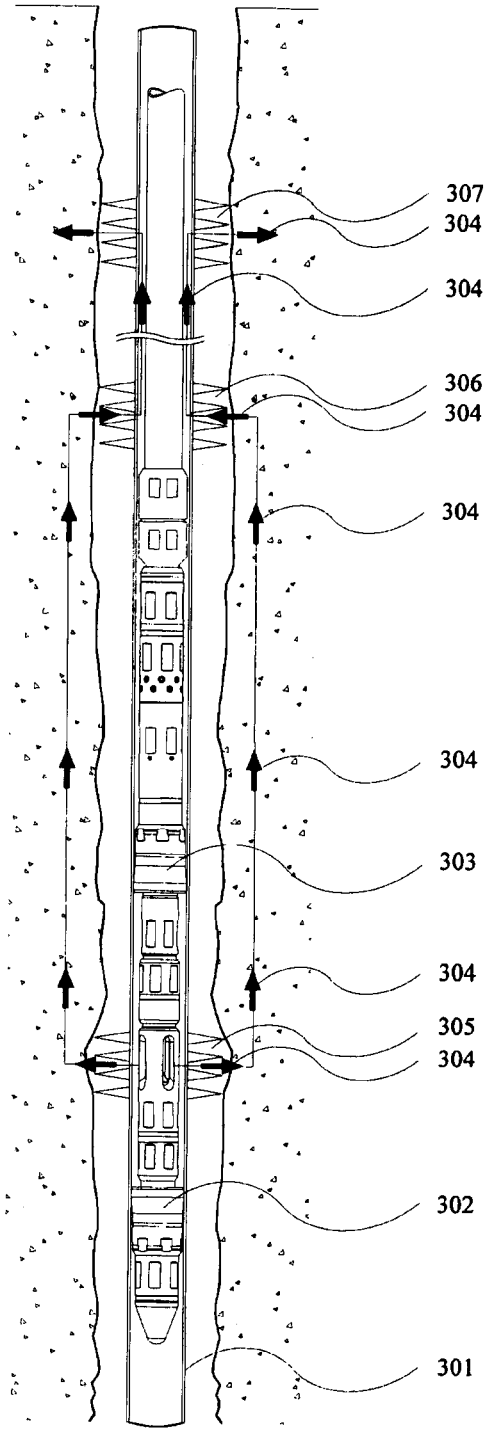
FIGURE 3A (Prior Art)
FIG. 3A is a schematic of a breakthrough of fracturing or stimulation fluids between adjacent sets of perforations, using prior art methods.

FIG. 3A shows the possibility of a fracture or other stimulation resulting in breakthrough between adjacent sets of perforations. A conventional coiled tubing fracturing tool is shown in a wellbore 301 with a bottom cup or set of cups 302, and an upper cup or set of cups 303. Injected fluids 304, which could include but not be limited to proppant-ladened fracturing fluids, acid, or nitrogen, are introduced to the target perforations as shown in the area generally indicated by 305. In some cases, the injected fluids 304 are allowed to migrate behind the wellbore 301 upward to an upper set of perforations as shown in the area generally indicated by 306 and reintroduced to the wellbore 301 through those perforations at 306. This could be due to poor cement bond between the wellbore and the formation, or due to vertical extension of a fracture outside the wellbore 301. In a case such as this, the injected fluids 304 may then communicate with another set of upper perforations in the area generally indicated by 307 causing unwanted fracture or stimulation of those upper perforations at 307. Such problems may also arise, as discussed above, when stimulating a well in rock that has natural fractures in it as the fracturing fluid may "short circuit" and follow the natural fractures in the rock and come up to a set of upper perforations, rather than going out into the formation.

Figure 3B:
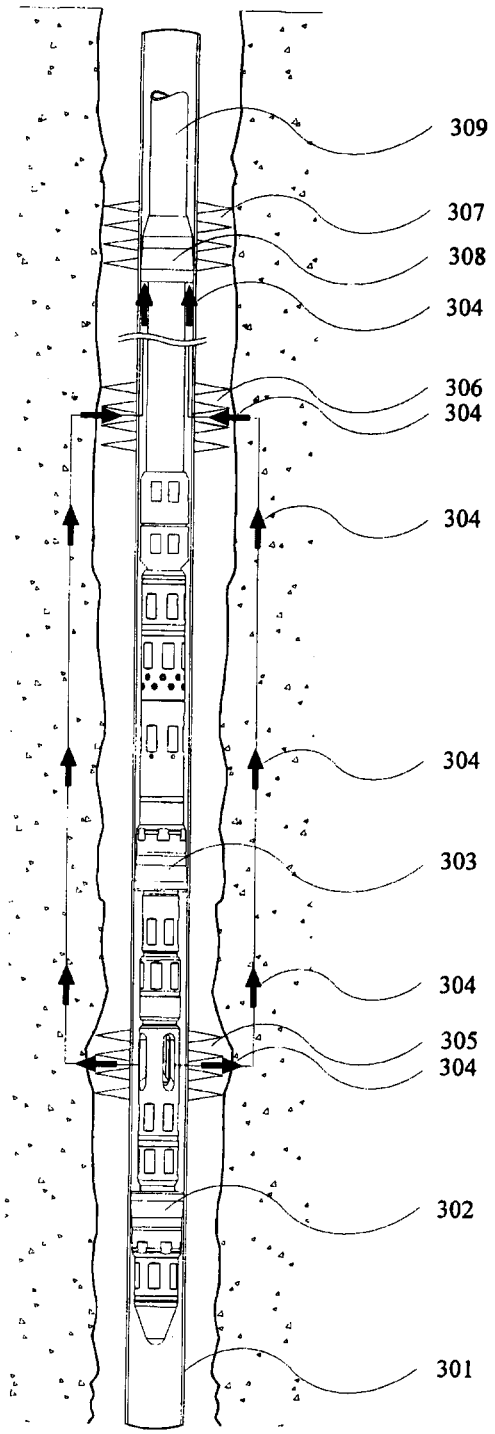
FIG. 3B is a schematic view of a moveable or split cup placement according to the invention.

FIG. 3B shows the placement of a moveable cup 308 (one piece or a split cup) on the coiled tubing 309 which contains the injected fluids 304 and prevents communication with the upper set of perforations at 307. Within this patent application, this use of the moveable cup system is referred to as "secondary containment".

Figure 3C:
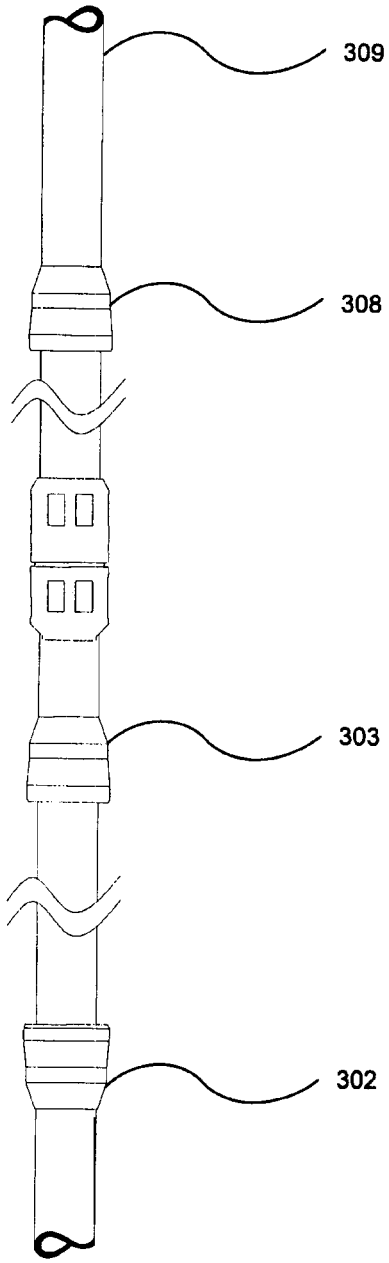
FIG. 3C is a side view of an illustration of the placement of a moveable or split cup, for secondary containment.

FIG. 3C expands the description of the placement olf the moveable cup for secondary containment which illustrates a conventional fracturing tool with a bottom cup 302, an upper cup 303, and a second upper cup 308 which is a moveable cup fixed to the coiled tubing 309.

Figure 4:
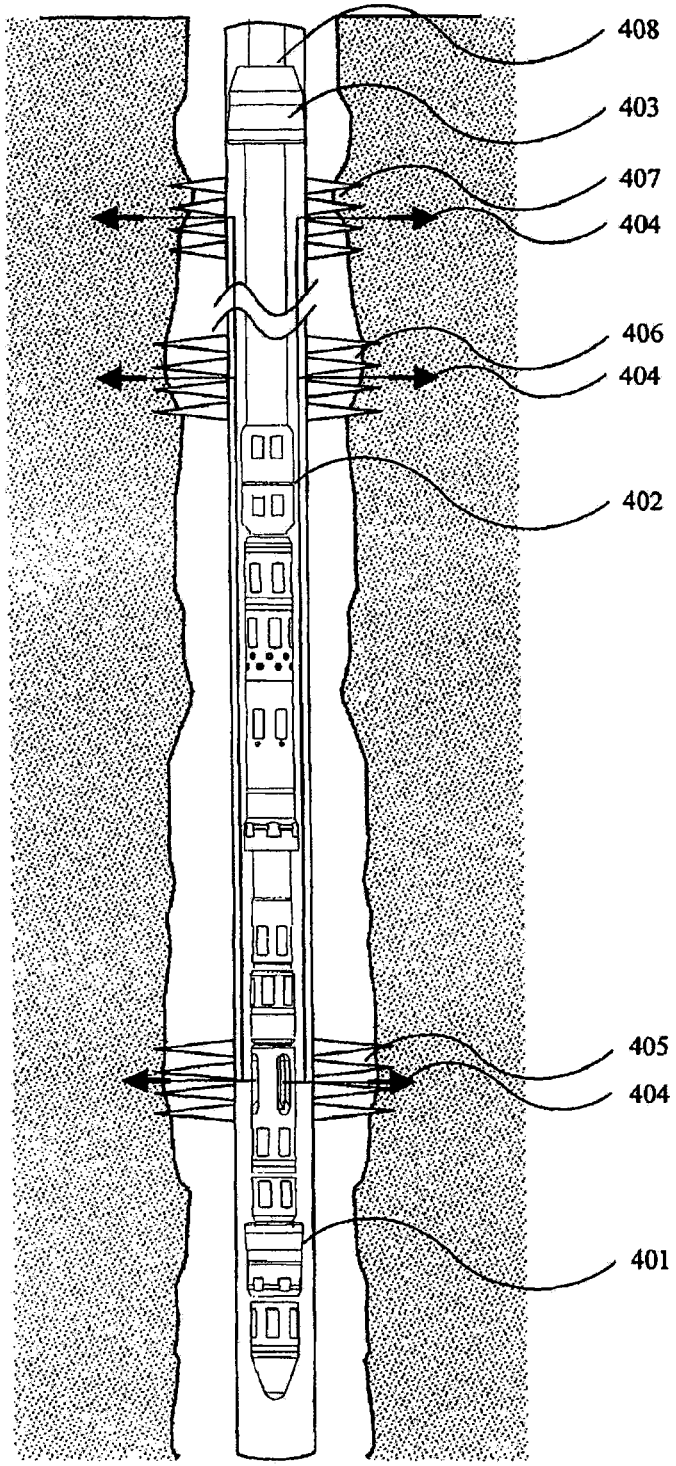
FIG. 4 is a schematic view of the use of a split or moveable cup according to the invention for an extended interval fracture or stimulation.

With reference to FIG. 4, it has been previously shown that a conventional coiled tubing fracturing tool would include one or more sets of opposing cups to contain injected pressure, and it has also been described that due to crane or lubricator limitations that the interval between these cups or sets of cups may be limited when the upper cups are integral to the coiled tubing tool which is attached to the coiled tubing. The moveable cup of the present invention addresses this limitation and allows the upper cup to be located any desired distance from the lower cup. FIG. 4 describes an application for a moveable cup where the coiled tubing fracturing tool is modified such that it is comprised of a bottom cup 401 but without an upper cup that is integral to the tool itself. The fracturing tool is connected to the coiled tubing 408 by a coiled tubing connector 402, but the upper cup is a moveable cup 403 (one piece or a split cup) which is located strategically on the coiled tubing 408 above the coiled tubing connector 402 so as to provide for an extended interval for fracturing or stimulation that exceeds that possible if the upper cup was integral to the coiled tubing fracturing tool and below the coiled tubing connector 402. In this application, injected fluids 404 are allowed to communicate and stimulate or fracture the formation through perforations in the area generally described by 405 which are adjacent to the tool, as well as perforations in the areas generally described by 406 and 407 which are vertically removed from the tool itself. This application is referred to as "extended length" fracturing or stimulation.

Figure 5A:
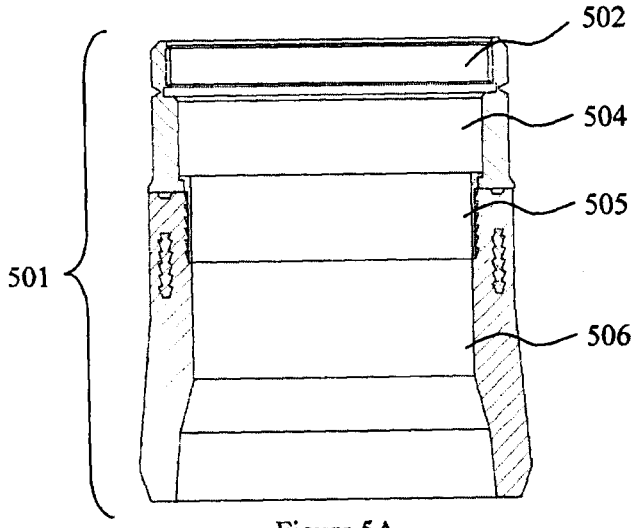
FIG. 5A is a partial section of an embodiment of a moveable cup assembly according to the invention for attachment to a string of coiled tubing.
Figure 5B:
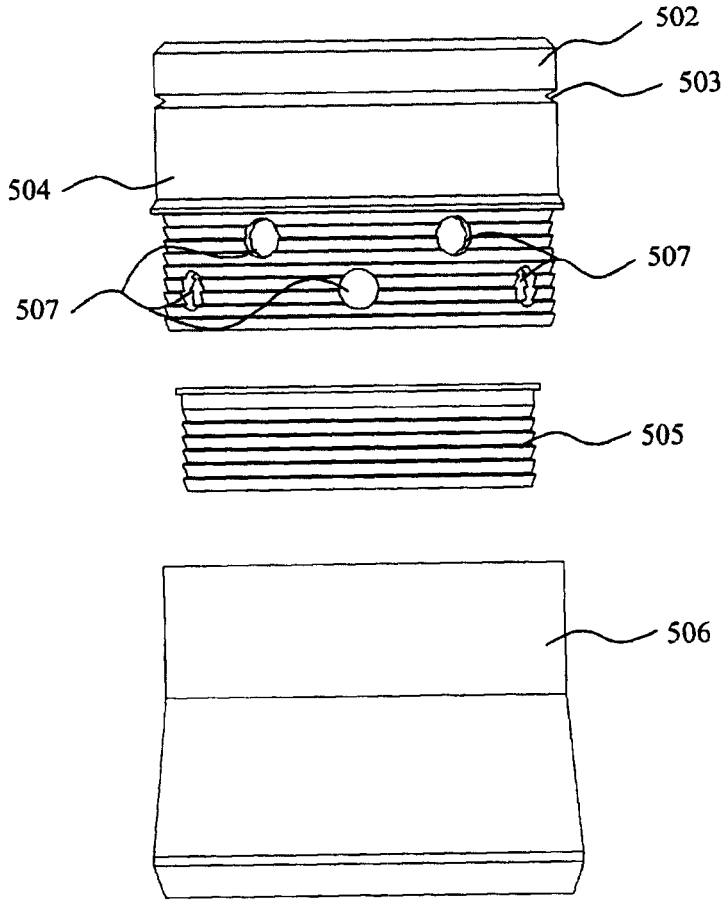
FIG. 5B is a side view of the moveable cup of FIG. 5A.

FIGS. 5A and 5B describe one embodiment of a movable cup. The movable cup has an enlarged inner diameter so that coil tubing can pass freely through the cup while running in hole before attaching the cup to the coil. Typical packer cups used for fracturing operations in 4.5 inch casing have an inner diameter of less than 2.625 inches whereas these cups have an ID of 3.000 inches. Additionally, the cup is attached to its mounting mandrel by screw threads which are machined into the inner diameter of the upper section of an outer thimble 4 and threaded onto a slip retainer. Conventional packer cups of prior art are attached to the mandrel with a tapered backup collar that sandwiches the back of the cup against the mandrel.

The cup is sealed to the coil tubing or mandrel by o-Rings or an alternative sealing technology. Conventional packer cups are sealed to their respective mounting mandrel by an interference fit created when their backup ring is tightened against the back end of the cup.

The cup also has a built in break away feature. If the cup becomes stuck in hole, it is possible to pull the cup apart. A notched section on the threaded portion of the cup has been engineered to break with a predetermined pull on the coil tubing.

In FIG. 5A an assembled movable cup 501 is shown. The movable cup 501 is comprised of an outer thimble 504, an inner thimble 505, and an elastomeric packer element 506. The elastomeric element is typically hydrogen saturated nitrite rubber (HSN) or polyurethane but could be any polymer deemed to be suitable for the down hole conditions expected to be encountered by this tool.

The construction of the cup may be conducted by several methods depending on the elastomer to be used. In one embodiment, the inner thimble 505 is placed inside the outer thimble 504 such that inner thimble 505 bottoms or shoulders out against the inner diameter of outer thimble 504. The inner thimble 505 and outer thimble 504 are then placed into a mold or cast which is pre-formed to provide the desired shape of the cup 506. Elastomeric material is then poured or compressed into the mold and allowed to harden or set and provide adhesion between the inner and outer thimbles and the elastomeric material.

FIG. 5B is an exploded view of the components of FIG. 5A to show additional detail. The surface of inner thimble 505 is ribbed to increase the adhesion between the elastomer and the inner thimble 505, and holes 507 may or may not be located in the outer thimble 504 again for the purpose of increasing adhesion between the elastomeric material and the thimble. A notched section 503 is machined into the outer thimble 504 to allow a break point or weak spot that will separate under a pre-determined axial force in the event the assembly gets stuck in the wellbore. The inner surface of the outer thimble 504 is threaded in the area generally described by 502 so it can be threaded onto the remainder of the assembly as described later in FIG. 6A.

An alternative embodiment would have the surfaces of the inner thimble 505 and the outer thimble 504 grit blasted so as to provide a roughened surface which would again improve the adhesion between the thimble material and the elastomeric material.

The process of injection or compression molding is a common operation that would require no further explanation to anyone skilled in those arts.

A second embodiment of this cup can be constructed with additional spring steel supports (not shown) for improved performance and structural support in severe applications. These spring steel supports could consist of concentric shells of sheet metal or fingers made from wire bent into a U shape. These spring steel supports are epoxied or welded or otherwise fixed in the cavity between the outer thimble 504 and the inner thimble 505. Other configurations of additional support have been contemplated and would be obvious to anyone skilled in the art of pack cup construction.

Figure 6A:
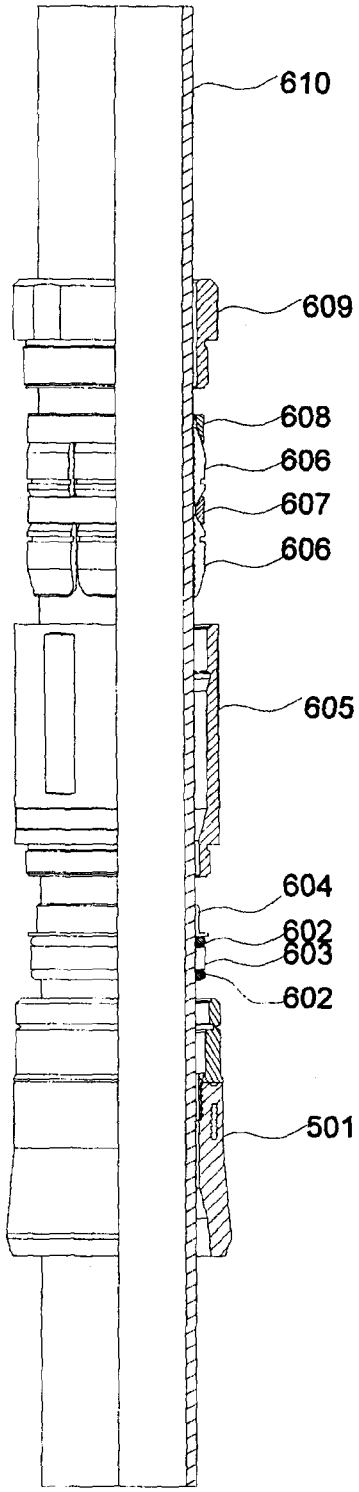
FIG. 6A is a partial section of a moveable cup assembly according to the invention.

FIG. 6A describes one embodiment of a moveable cup system for selectively fracturing or stimulating extended intervals with coiled tubing as described previously with a moveable cup system.

A moveable frac cup 501 is threaded onto a slip retainer device 605 and mounted onto coiled tubing 610. The outer diameter and stiffness of the moveable frac cup 501 is such that when run into casing and subject to pressure from below the cup, the cup expands to form a seal against the casing inner diameter. Two o-ring devices 602 are situated inside the top of the moveable cup 501 to form a seal between the inner surface of the moveable cup 501 and the coiled tubing 610. An o-ring spacer 603 is located between the two o-rings 602 to provide separation and integrity between the o-rings 602 and an ID-reducing sleeve 604 is used to eliminate any void space between the coiled tubing 610 and the slip retainer 605. The o-ring spacers 603 and ID reducing sleeves 604 are necessary to back up the o-rings to prevent them from being extruded unto the slip retainer 605. Although not explicitly shown in the diagram, the o-ring Spacers 603 and ID reducing sleeve 604 are each manufactured in two halves to allow for installation onto the pipe.

The slip retainer 605 provides a means of locating several slips 606 between the slip retainer 605 and the coiled tubing 610. The slips are situated in two layers within the slip retainer 605 and are counter-acting in nature to prevent movement in either direction along the coiled tubing 610. In the embodiment of FIG. 6A, the two layers of external grapples 606 are separated and spaced by a middle slip backing ring 607. The upper layer of slips 606 are held in the slip retainer 605 by a slip backing ring 608. A backup nut 609 is used to hold the grapples 606 in place and threading the backup nut 609 into the slip retainer 605 transmits and axial force the slip backing ring 608 and to the middle slip backing ring 607 to activate the slips 606.

Figure 6B:
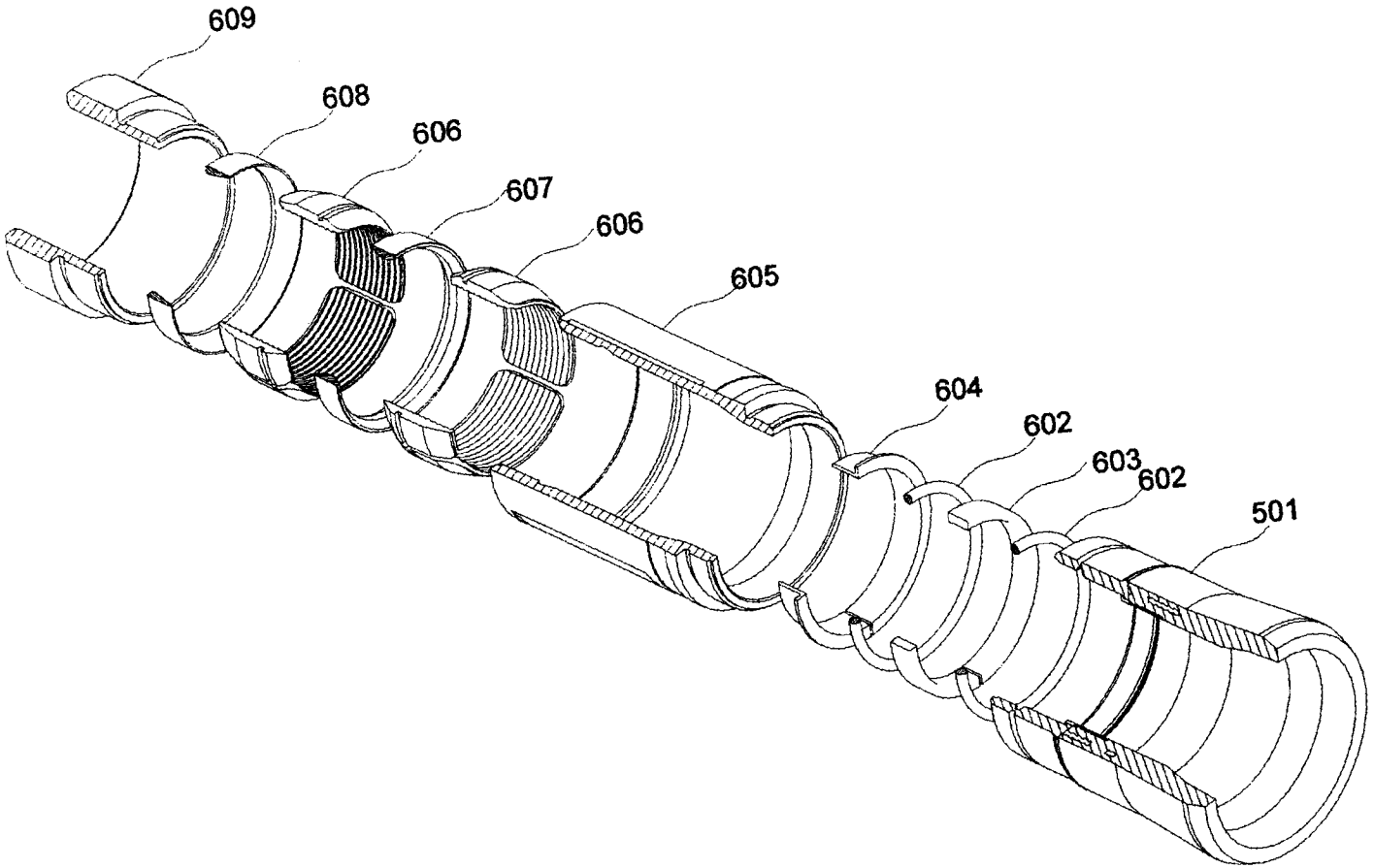
FIG. 6B is an exploded view of the moveable cup assembly of FIG. 6A.

FIG. 6B is an exploded view of the components of FIG. 6A, without the coiled tubing 610, to provide additional detail on the individual components.

Figure 7:
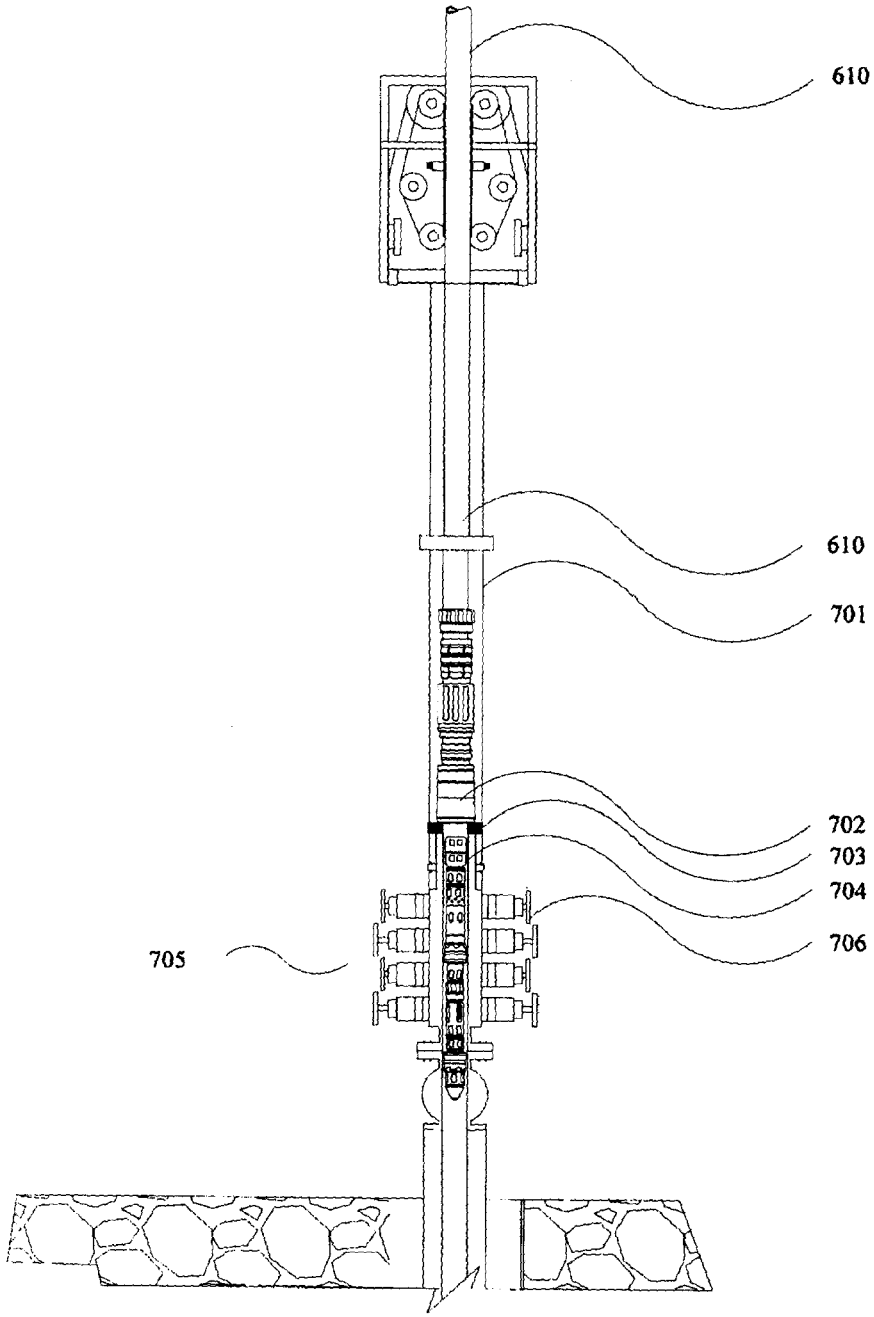
FIG. 7 is a side view of one embodiment of the equipment used for the installation of a moveable cup assembly according to the invention.

FIG. 7 shows the rig-up for equipment for the installation of a moveable cup assembly. A work window 701 is used to allow access to the coiled tubing 610 after the coiled tubing 610 has been run into the hole. A work window is a common coiled tubing operating device to those skilled in the art and requires no special description. The work window 701 is used to allow the moveable cup assembly 702 to be installed on the coiled tubing 610 above a bottom hole assembly 704. A cup retention device 703 is used in the work window 701 to hold the moveable cup assembly 702 stationary in the work window 701 as the coiled tubing 610 is run in the hole. This cup retention device 703 can be as simple as a C-plate, which is well-known to those skilled in the art of coiled tubing operations and is not described further here.

The work window 701 is attached to a blowout preventer generally indicated by the area described by 705 which houses one or more ram-type blowout prevention devices, one of which would be a pipe ram assembly 706. Pipe ram assemblies are also common devices well-known to those skilled in the art of coiled tubing operations and are therefore not described in more detail.

For installation of the moveable cup assembly, a dimple connector (not shown) is attached to the end of the coiled tubing 610 to allow for future installation of the bottom hole assembly 704. A dimple connector is also a common device to those skilled in the art so is not shown or described further.

With reference to FIG. 6A or 6B, to prepare the movable cup assembly described as 702 in FIG. 7, the back up nut 609 is threaded onto coiled tubing 610, and then slid on the slip backing ring 608. The middle slip backing ring 607 is then also slid onto the coiled tubing 610.

Two o-rings 602 are pressed onto the threads of the slip retainer 605. A movable cup 501 is threaded onto the slip retainer 605 to hold the o-rings 602 in place. The slip retainer 605 and movable cup 501 with o-rings 602 are then slid onto the coiled tubing 610. The slip backing ring 608 is allowed to fall into the slip retainer 605 and the backing nut 609 is threaded loosely into the slip retainer 605 so as to hold the assembly together.

If additional moveable cups are to be installed, this process is repeated for each additional cup assembly.

Referring back to FIG. 7, the bottom hole assembly 704 is connected to the coiled tubing using standard coiled tubing operational procedures.

The bottom hole assembly 704 and movable cup or cups 702 are then stabbed into the work window 701. The cup retention means 703 is placed in the work window 701 between the bottom movable cup assembly 702 and the bottom hole assembly 704. The work window 701 is closed and the coiled tubing 610 is run in hole to the desired depth while the cup retention means 703 holds the moveable cup assembly 702 stationary in the work window 701.

Once at the desired separation between the moveable cup assembly 702 and the bottom hole assembly 704, the coiled tubing 610 is stopped and the pipe rams 706 closed to isolate the work window 701 from the wellbore. The work window 701 is opened to expose the coiled tubing 610 and the moveable cup assembly 702.

Referring again to FIG. 6A, the moveable cup 501 is unthreaded from the Slip Retainer 605 and the o-rings 602 removed from the Slip Retainer 605 and allowed to relax around the coiled tubing 610. The first o-ring 602 is slid into the bottom of the packing gland of the slip retainer 605 and pushed it to the bottom of the gland. The o-ring spacer halves 603 are inserted into slip retainer 605, and the upper o-ring 602 is slid down on top of the o-ring spacer 603.

The backup nut 609 and slip backup rings 608 are removed from the slip retainer 605. The ID reducing sleeve halves 604 are placed into the bottom of the slip retainer 605 and the movable cup 501 is threaded onto the Slip Retainer 605 which locks the o-rings 602 and o-ring spacer 603 and ID reducing sleeve 604 into place.

The first layer of slips 606 are installed in the top of the slip retainer 605 and the middle slip backup ring 607 is placed into the slip retainer 605 on top of the first layer of slips 606. Each layer of slips would normally consist of three slips but could be more or could be less. The second layer of slips 606 are then inserted into the slip retainer 605 on top of the middle slip backing ring 607 and the slip backing ring 608 is lowered down into the slip retainer on top of the upper layer of slips 606. The backup nut 609 is then threaded into the slip retainer 605 and tightened to activate the slips 606 against the coiled tubing 610.

Referring again to FIG. 7, the cup retention means 703 is then removed from the work window 701 and the work window 701 is closed, the pipe ram assembly 706 opened, and the coiled tubing run 610 in hole to the desired depth for stimulation operations.

Upon completion of stimulation operations, the coiled tubing 610 is pulled out of hole to the depth that the cup was installed. The movable cup assembly 702 is pulled into the work window 701, the pipe rams 706 closed, the work window 701 opened, and the cup retention means 703 located in the work window 701. The movable cup 501 is unthreaded from the Slip Retainer 605 and the ID reducing sleeve halves 604 and the o-ring Spacers 603 removed and the o-rings 602 cut off the coiled tubing 610. The backup nut 609 is unthreaded and the slips 606 removed. The remaining components are then loosely threaded back together and allowed to fall onto the pipe rams 706 inside the blowout preventer 705.

The work window 701 is closed the pipe rams 706 opened and the coiled tubing 610 is pulled out of the hole as per standard coiled tubing operating procedures.

In another embodiment of the present invention the moveable pressure containment device consists of a split cup design that allows the pressure containment device or fracture cup and retaining means to be mounted directly to the coiled tubing without the need to place the device on the coiled tubing while the coiled tubing is at surface.

Figures 8A, 8B:
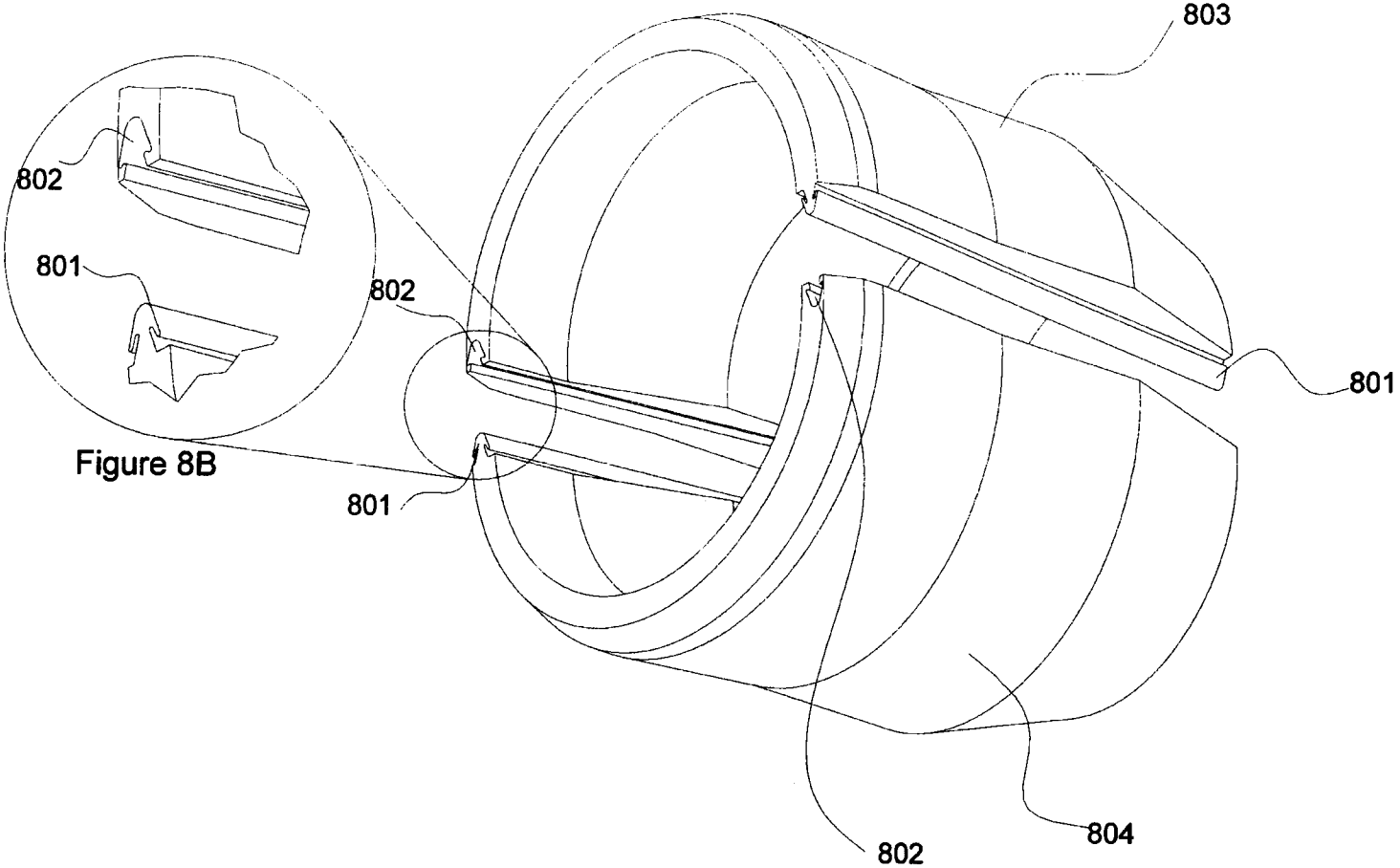
FIG. 8A is a perspective view of a split cup design according to the invention.
FIG. 8B is an enlarged view of a section of the joining surface of the split cup of FIG. 8A.

With reference to FIG. 8A, a fracturing/moveable cup design is shown which is halved to allow the cup to be placed on the coiled tubing after the coiled tubing is already at some depth in the wellbore. The cup is of the same shape and dimensions as the cup 506 shown in FIG. 5B with the exception that it is machined or molded in two distinct halves 803 and 804. Each half is shown to have a male connecting end 801 and a female connecting end 802 such that when the two halves 803 and 804 are connected together by a compressive force the two ends 801 and 802 mate together to form a pressure integral seal. FIG. 8B shows one embodiment of the design of the mating surfaces, however numerous different designs can be used to accomplish the same function as those shown in by 801 and 802.

With reference now to FIG. 9A, the two cup halves 803 and 804 are shown to be joined over coiled tubing 901 and mating surfaces 801 and 802 are shown to be closed on the coiled tubing 901. The two cup halves 803 and 804 are fixed in place on the coiled tubing 901 and two packer cup mandrel halves 902 and 903 and locked in place by locking bolts 904.

FIG. 9B is a cross-section of the split cup assembly shown in FIG. 9A as described by section line A-A'. The packer cup mandrel halves 902 and 903 are shown to be fixed to the coiled tubing 901 by a series of slips 905 that are restrained in place under two cup mandrel halves 902 and 903. The cups are additionally restrained by a series of interlocking grooves 906 that mate the outside of the packer cups 803 and 804 with the cup mandrel halves 902 and 903. A packing cavity 907 is machined into both the top of the packer cups and the packer cup mandrel halves 902 and 903 to allow for insertion of packing, to provide pressure isolation between the coiled tubing 901 and the packer cup halves 803 and 804. The packer cup mandrel halves 902 and 903 are locked into place on the coiled tubing 901 by one or more bolts 904. To provide additional pressure support, the mating surfaces of the cup halves 801 and 802 are offset 90 degrees from the mating surface of the cup mandrel halves 902 and 903.

Figure 10:
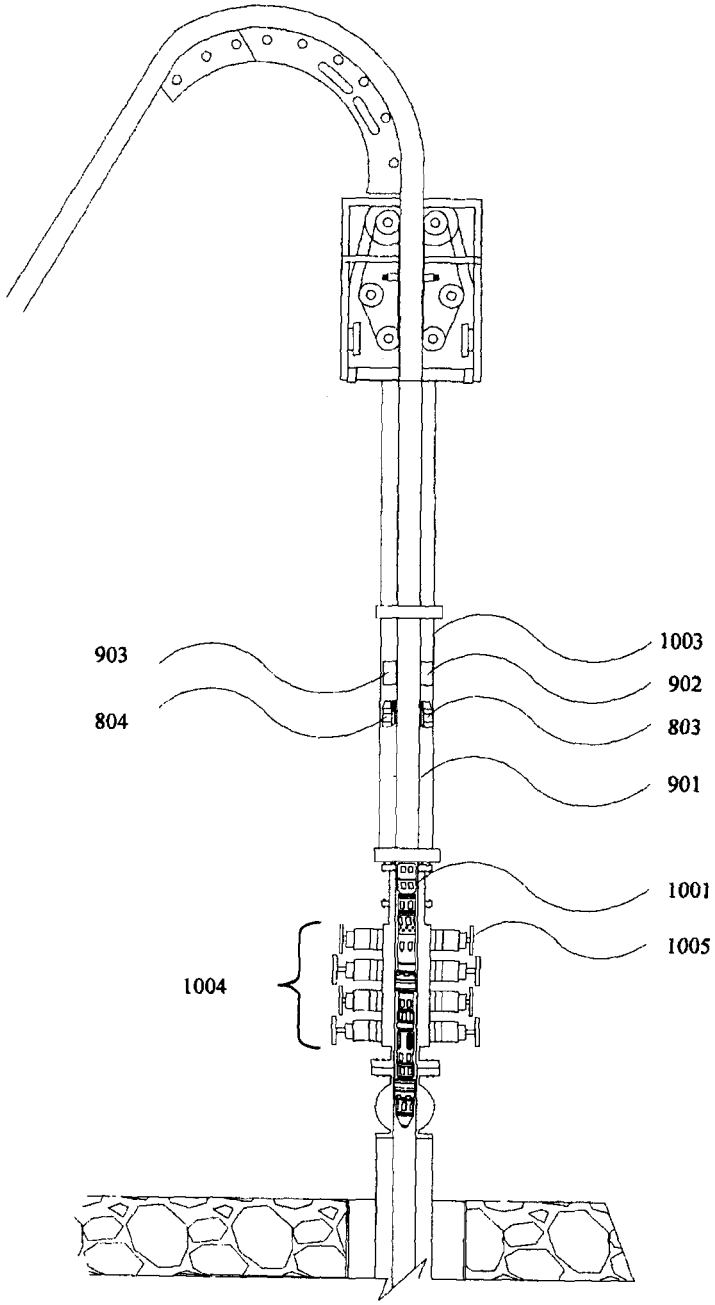
FIG. 10 is a side view of equipment used for the installation of a split cup assembly according to the invention.

With reference now to FIG. 10, a coiled tubing fracturing or stimulation tool 1001 is connected to coiled tubing 901 and lubricated into a wellbore according to conventional coiled tubing methods. The coiled tubing fracturing or stimulation tool is configured with a bottom cup and may or may not be configured with a top cup depending on the purpose of the operation. A top cup is used when the split cup is intended for secondary pressure containment and a top cup is not used the if split cup is intended for extended length fracture or stimulation. A work window 1003 is connected to the top of the blowout prevention stack 1004 and the coiled tubing fracturing tool 1001 is run into the wellbore to a depth determined by the desired location of the split cup. Once at the desired depth, the coiled tubing 901 is stopped and the pipe rams 1005 activated to isolate the work window 1003 from wellbore pressure. The work window 1003 is bled down and opened to allow access to the coiled tubing 901. The split cup halves 803 and 804 are attached to the coiled tubing 901, packing elements (not shown) placed in the packing cavity (907 shown in FIG. 9B) and the slips (905 shown in FIG. 9B) placed on the coiled tubing 901. The cup halves 803 and 804 and slips 905 and packing elements are locked in place on the coiled tubing 901 by the packer cup mandrel halves 902 and 903 by the locking bolts (904 as shown in FIGS. 9A and 913). The work window 1003 is then closed, the pipe rams 1005 opened, and the coiled tubing 901 is run in hole to the desired depth for the fracturing or stimulation operation.

Removal of the split cups are done by tagging the split cup assembly at the window or coiled tubing injector while pulling out of hole, closing the pipe rams 1005, bleeding down the work window 1003, opening the work window 1003 and removing the split cup assembly by removing the bolts 904 and the remainder of the split cup assembly. The work window 1003 is then closed again, the pipe rams 1005 opened, and the coiled tubing fracturing or stimulation tool 1001 pulled to surface as per common coiled tubing operations.

It should be understood that the description of the installation and assembly of the moveable cups (one piece or a split cup, as describe above) may include one or more sets of moveable cups depending on the extent of pressure containment required. Many modifications are anticipated to the assembly and installation procedures.

What are claims:

1. A method of pressure containment in a wellbore having multiple zones to be fractured comprising the steps of:

providing a coiled tubing with a set of fixed pressure containment devices on the coiled tubing;

providing a movable pressure containment device that can be positioned anywhere along the length of the coiled tubing uphole of the set of fixed pressure containment devices;

inserting the coiled tubing into the wellbore to a first depth while maintaining the movable pressure containment device at surface;

fixing the movable pressure containment device in a position on the tubing at a desired distance from the set of fixed pressure containment devices; and inserting the tubing into the wellbore to a second depth;

whereby the set of fixed pressure containment devices straddle a target zone to be fractured and the moveable pressure containment device is positioned uphole of top most perforation located above the target zone.

2. The method of pressure containment according to claim 1, further providing a bottomhole assembly, and wherein the fixed pressure containment devices are fixed to the bottomhole assembly.

3. The method of pressure containment according to claim 2, wherein the bottomhole assembly is a fracturing tool.

4. The method of pressure containment according to claim 1, wherein the movable pressure containment device includes a locking means for fixing the movable pressure containment device onto the tubing such that the moveable pressure containment device is lowered simultaneously with the tubing while the tubing is inserted into the wellbore to the second depth.

5. The method of pressure containment according to claim 1, further including the step of introducing fluid into the wellbore downhole of the movable pressure containment device and whereby the moveable pressure containment device restricts the circulation of the fluid uphole of the movable pressure containment device.

6. The method of pressure containment according to claim 1 wherein the fixed pressure containment devices are packer cups.

7. The method of pressure containment according to claim 1 wherein the moveable pressure containment device is a packer cup.

8. The method of pressure containment according to claim 1, wherein the movable pressure containment device is on the tubing prior to the step of inserting the coiled tubing into the wellbore to a first depth, and wherein during step of inserting the coiled tubing into the wellbore to a first depth, the coiled tubing is passed through the moveable pressure containment device while maintaining the movable pressure containment device at the surface.

9. The method of pressure containment according to claim 1 wherein the movable pressure containment device is positioned on the tubing following the step of inserting the coiled tubing into the wellbore to a first depth.

10. The method of pressure containment according to claim 9 wherein the moveable pressure containment device is a split cup.

* * * * *